US011527356B2

(12) United States Patent
Kong et al.

(10) Patent No.: US 11,527,356 B2
(45) Date of Patent: Dec. 13, 2022

(54) METHOD FOR PRODUCING HEAVY RARE EARTH GRAIN-BOUNDARY-DIFFUSED RE—FE—B-BASED RARE EARTH MAGNET AND HEAVY RARE EARTH GRAIN-BOUNDARY-DIFFUSED RE—FE—B-BASED RARE EARTH MAGNET PRODUCED THEREBY

(71) Applicant: Star group Ind. Co., Ltd., Daegu (KR)

(72) Inventors: Koon Seung Kong, Daegu (KR); Dong Hwan Kim, Daegu (KR)

(73) Assignee: STAR GROUP IND. CO., LTD., Daegu (KR)

( * ) Notice: Subject to any disclaimer, the term of this patent is extended or adjusted under 35 U.S.C. 154(b) by 520 days.

(21) Appl. No.: 16/441,251

(22) Filed: Jun. 14, 2019

(65) Prior Publication Data

US 2019/0385790 A1 Dec. 19, 2019

(30) Foreign Application Priority Data

Jun. 15, 2018 (KR) ..... 10-2018-0068828

(51) Int. Cl.

| | |
|---|---|
| ***H01F 41/02*** | (2006.01) |
| ***B22F 3/24*** | (2006.01) |
| ***H01F 1/057*** | (2006.01) |
| ***C22C 38/00*** | (2006.01) |

(52) U.S. Cl.

CPC ..... *H01F 41/0293* (2013.01); *B22F 3/24* (2013.01); *C22C 38/002* (2013.01); *C22C 38/005* (2013.01); *H01F 1/0577* (2013.01); *B22F 2003/248* (2013.01); *B22F 2201/11* (2013.01); *B22F 2201/20* (2013.01); *B22F 2301/355* (2013.01); *B22F 2998/10* (2013.01); *B22F 2999/00* (2013.01); *C22C 2202/02* (2013.01)

(58) Field of Classification Search

CPC ..... B22F 3/24; B22F 2003/247; B22F 2003/248; B22F 2201/10; B22F 2201/11; B22F 2201/12; B22F 2201/20; B22F 2301/355; B22F 2301/45; C22C 38/002; C22C 38/005; C22C 2202/02

See application file for complete search history.

(56) References Cited

U.S. PATENT DOCUMENTS

| | | | | |
|---|---|---|---|---|
| 2003/0189475 | A1* | 10/2003 | Blume | H01F 1/0578 335/302 |
| 2008/0247898 | A1* | 10/2008 | Nakamura | B22F 3/24 419/9 |
| 2013/0271248 | A1* | 10/2013 | Nagata | B22F 3/26 335/302 |
| 2019/0228800 | A1* | 7/2019 | Muramatsu | G11B 5/70678 |

FOREIGN PATENT DOCUMENTS

| | | | | |
|---|---|---|---|---|
| JP | 6163226 | A * | 6/1994 | |
| KR | 101516567 | B1 * | 5/2015 | |
| WO | WO-2018074162 | A1 * | 4/2018 | G11B 5/70642 |

* cited by examiner

*Primary Examiner* — Anthony J Zimmer
*Assistant Examiner* — Dean Mazzola
(74) *Attorney, Agent, or Firm* — Rabin & Berdo, P.C.

(57) ABSTRACT

A method for producing a heavy rare earth grain-boundary-diffused RE-Fe—B-based rare earth magnet and a heavy rare earth grain-boundary-diffused RE-Fe—B-based rare earth magnet produced thereby is disclosed. More particularly, a method for producing a heavy rare earth grain-boundary-diffused RE-Fe—B-based rare earth sintered magnet having a reduced content of a heavy rare earth element is disclosed, in which a hydrogen compound of a heavy rare earth is mainly used as a diffusion material in the production of the grain-boundary-diffused magnet so that a product having uniform and stable quality can be produced. The coercive force of the magnet can be increased while minimizing the amount of heavy rare earth used in the production of the grain-boundary-diffused magnet, by solving the problem that the heavy rare earth is not uniformly diffused into the magnet, and a heavy rare earth grain-boundary-diffused RE-Fe—B-based rare earth magnet produced thereby.

5 Claims, No Drawings

METHOD FOR PRODUCING HEAVY RARE EARTH GRAIN-BOUNDARY-DIFFUSED RE—FE—B-BASED RARE EARTH MAGNET AND HEAVY RARE EARTH GRAIN-BOUNDARY-DIFFUSED RE—FE—B-BASED RARE EARTH MAGNET PRODUCED THEREBY

CROSS-REFERENCE TO RELATED APPLICATIONS

This application claims the benefit of Korean Patent Application No. 10-2018-0068828, filed on Jun. 15, 2018, in the Korean Intellectual Property Office, which is incorporated herein by reference in its entirety.

BACKGROUND OF THE INVENTION

1. Field of the Invention

The present invention relates to a method for producing a heavy rare earth grain-boundary-diffused RE-Fe—B-based rare earth magnet and a heavy rare earth grain-boundary-diffused RE-Fe—B-based rare earth magnet produced thereby, and more particularly to a method for producing a heavy rare earth grain-boundary-diffused RE-Fe—B-based rare earth sintered magnet having a reduced content of a heavy rare earth element, in which a hydrogen compound of a heavy rare earth is mainly used as a diffusion material in the production of the grain-boundary-diffused magnet, so that a product having uniform and stable quality can be produced, and the coercive force of the magnet can be increased while minimizing the amount of heavy rare earth used, by solving the problem that the heavy rare earth is not uniformly diffused into the magnet, and a heavy rare earth grain-boundary-diffused RE-Fe—B-based rare earth magnet produced thereby.

2. Description of Related Art

In recent years, energy-saving and environmentally friendly green growth projects have emerged as a new issue. Thus, in the car industry, studies have been actively conduced either on hybrid cars that use a motor in combination with a fossil fuel-based internal combustion engine, or on fuel cell vehicles that generate electricity using the environmentally friendly energy source hydrogen or the like as alternative energy and drive the motor using the generated electricity.

Since these environmentally friendly vehicles feature that they are commonly driven by electric energy, permanent magnet type motors and generators are inevitably employed. In addition, in the aspect of magnetic materials, the technical demand for rare earth sintered magnets, which exhibit better magnetic properties in order to further improve energy efficiency, is increasing.

In order to improve the fuel economy of environmentally friendly vehicles, it is needed to realize weight reduction and miniaturization of driving motors, as well as vehicle parts used in steering devices, electrical/electronic devices and the like. For example, in order to realize weight reduction and miniaturization of a motor, it is essential to replace the permanent magnet material with a rare earth sintered magnet that exhibits better magnetic performance than the ferrite used in the past, while changing the multifunctional design of the motor.

The production volume of the environmentally friendly vehicles described above is expected to increase gradually in the future for various reasons, including rising oil prices caused by increased energy usage, interest in solving health problems caused by environmental pollution, and gradually strengthening carbon emission regulation policies as a long-term countermeasure against global warming in various countries of the world.

On the other hand, the permanent magnets employed in these environmentally friendly vehicles are required to have a high coercive force of 25 to 30 kOe or more, because they should stably maintain their original function without losing their performance even in a high temperature environment at 200° C.

In a conventional method for producing a rare earth sintered magnet having a high coercive force as described above, an alloy for the magnet is designed to have a composition comprising a heavy rare earth element such as dysprosium (Dy) or terbium (Tb), which replaces 5 to 10 wt % of a light rare earth element such as neodymium (Nd) or praseodymium (Pr). However, the heavy rare earth element, such as Dy or Tb, which is used in this method, is 4 to 10 times higher in price than a light rare earth element such as Nd or Pr, and has a resource constraint due to its limited global reserves. Thus, in order to expand the application field of rare-earth magnets and solve smooth supply and demand issues thereof, an invention relating to a novel magnet producing method for improving a coercive force while minimizing the content of the heavy rare earth element is required.

Theoretically, the residual magnetic flux density of a permanent magnet is determined by various conditions, such as the saturation magnetic flux density of the main phase of the magnet material, the degree of anisotropy of the grains, and the density of the magnet. As the residual magnetic flux density of a permanent magnet increases, this magnet can generate a stronger magnetic force to the outside, and thus has an advantage in that it can improve the efficiency and output of devices in various applications. On the other hand, the coercive force, which indicates the other performance of the permanent magnet, plays a role in maintaining the inherent performance of the permanent magnet against environments that demagnetize the magnet, such as heat, a reverse magnetic field, and a mechanical impact. Thus, the higher the coercive force of the permanent magnet is, the better the environmental resistance of the permanent magnet is, so that this permanent magnet can be used in high-temperature appliances and high-output devices. In addition, this permanent magnet can be produced to have thinness so that its weight can be reduced and thus its economic value can be increased.

In a conventional method for producing a rare earth sintered magnet having a high coercive force and stable thermal properties, an alloy for the magnet is generally designed to have a composition comprising a heavy rare earth element such as Dy or Tb, which replaces 5 to 10 wt % of a light rare earth element such as Nd or Pr. However, the heavy rare earth element, such as Dy or Tb, which is used in this method, is 4 to 10 times higher in price than a light rare earth element such as Nd or Pr, and has a resource constraint due to its limited global reserves. Thus, in order to expand the application field of rare-earth magnets and solve smooth supply and demand issues thereof, a production method for minimizing the content of a heavy rare metal element needs to be proposed.

From this point of view, since 2000, research institutes and rare earth magnet manufacturing companies in various countries of the world have developed methods for improving the coercive force while minimizing the use of heavy rare earth elements. Examples of representative methods developed so far include a method of refining the grains of a rare earth sintered magnet, and heavy rare earth grain boundary diffusion methods in which a heavy rare earth element is diffused onto the surface of a rare earth magnet to minimize the use of the heavy rare earth element.

Among these representative methods of reducing the use of heavy rare earth elements, the method of refining the grains has been developed by Intermetallics Co., Ltd. (Japan) and the like. This technology is characterized in that fine powder is manufactured using a high-speed grinding apparatus in a process of manufacturing a magnet alloy and powder, and the grain size of the final sintered body is finely controlled to 1 to 2 μm compared to conventional 6 to 8 μm. However, this technology has disadvantages in that the fine powder used is easily oxidized due to its sensitivity to oxygen, and thus is not easy to control in an oxygen-free atmosphere during the process, and in that the sintering behavior of the fine powder in the sintering process is not uniform, and thus partially coarse grains are formed. Due to such various problems that are difficult to solve, this technology has not yet been applied to mass production.

The grain boundary diffusion technology, another heavy rare earth reduction technology, has been developed by Shin-Etsu Chemical Co., Ltd. (Japan), Hitachi Metals Co., Ltd. (Japan), TDK (Japan) and the like. It is a method in which a sintered magnet is produced according to a conventional method, and then a heavy rare earth compound is applied to the surface of the magnet by various methods, including powder application, deposition and plating, and heated to a temperature of 700° C. or higher in an argon or vacuum atmosphere so that the heavy rare earth applied to the magnet surface is gradually diffused along the magnet grain boundaries and penetrated into the magnet. After the heavy rare earth is penetrated into the magnet along the grain boundaries by the diffusion reaction, heavy rare earth is concentrated around the grain boundaries by the diffusion reaction. Because of the inherent nature of the rare earth sintered magnet, magnetic defects that reduce the coercive force are mostly distributed in the grain boundaries. Thus, if the heavy rare earth is concentrated on the grain boundaries, the heavy rare earth exhibits the effect of increasing the coercive force by removing the magnetic defects. Therefore, the heavy rare earth grain boundary diffusion technology is proposed as the most reasonable method of reducing the use of the heavy rare earth element, because it exhibits the maximum effect of increasing the coercive force while minimizing the use of the heavy rare earth by allowing the heavy rare earth to be selectively distributed in the grain boundaries.

Meanwhile, in the heavy rare earth grain boundary diffusion process, the heavy rare earth applied to the surface of the magnet must propagate along the grain boundary surface having a narrow width of several nm when being diffused and penetrated into the magnet. Thus, there occurs a problem that the uniform composition distribution of the heavy rare earth in an area ranging from the surface of the magnet to the inner center thereof cannot be maintained. More specifically, only a part of the heavy rare earth that has rapidly penetrated through the surface of the magnet in the initial diffusion stage is penetrated into the magnet along the narrow grain boundaries, and as the penetration into the magnet progresses, the diffusion rate gradually becomes slower. Hence, measurement of the distribution of the heavy rare earth in the grain boundary-diffused magnet reveals that the magnet surface has a high concentration of the heavy rare earth and the inside of the magnet does not substantially have the heavy rare earth, indicating that the distribution of the heavy rare earth in the magnet is not uniform.

This non-uniform distribution of the heavy rare earth in the magnet causes severe residual stress in the magnet, and prevents sufficient improvement in the coercive force and thermal demagnetization characteristics of the magnet in terms of magnetic properties. More specifically, the non-uniform distribution of the heavy rare earth causes residual stress on the surface and prevents the heavy rare earth from being stably applied to the inner grains. These defects act as a factor that deteriorates the magnetic performance, leading to a decrease in the coercive force. In addition, measurement of the thermal demagnetization characteristics of a conventional magnet and a grain boundary diffused magnet, which have the same coercive force in a temperature range of from the room temperature to high temperature, reveals that, in 1 to 2% of the irreversible demagnetization region in the initial stage, the thermal demagnetization characteristics of the grain boundary diffused magnet are lowered rather than raised, compared to those of the conventional magnet. This lowering is believed to be attributed to the residual stress caused by the non-uniform distribution of the heavy rare earth as mentioned above.

SUMMARY OF THE INVENTION

The present invention has been made to solve the above-mentioned problems associated with the prior art, and it is an object of the present invention to provide a method for producing a heavy rare earth grain-boundary-diffused RE-Fe—B-based rare earth sintered magnet having a reduced content of a heavy rare earth, in which a product having uniform and stable quality can be produced, and the coercive force of the magnet can be increased while minimizing the amount of heavy rare earth used, by solving the problem that the heavy rare earth is not uniformly diffused into the magnet, and a heavy rare earth grain-boundary-diffused RE-Fe—B-based rare earth magnet produced thereby.

Another object of the present invention is to provide a method for producing a heavy rare earth grain-boundary-diffused RE-Fe—B-based rare earth magnet having improved coercive force and thermal demagnetization characteristics, and ensuring uniform quality by developing a technology that controls the diffusion rate and eliminates the residual stress through heat-treatment temperature and time, a change in heating rate, and a post-heat treatment such as repeated heat-treatment in order to improve the coercive force and thermal demagnetization characteristics of the magnet after grain boundary diffusion by eliminating the residual stress caused by diffusion after diffusion treatment, and a heavy rare earth grain-boundary-diffused RE-Fe—B-based rare earth magnet produced thereby.

Still another object of the present invention is to provide a method for producing a heavy rare earth grain-boundary-diffused RE-Fe—B-based rare earth sintered magnet which is widely used in various industrial fields, including the automotive field, the home appliances field, the IT field, and the medical field, and in which the production cost of the magnet can be significantly reduced and the coercive force and thermal stability of the magnet can be improved by using an improved heavy rare earth grain boundary diffusion technology through a sintered body block obtained using a suitably ground rare earth sintered magnet as a starting material, and a heavy rare earth grain-boundary-diffused RE-Fe—B-based rare earth magnet produced thereby.

Yet another object of the present invention is to provide a method for producing a heavy rare earth grain-boundary-diffused RE-Fe—B-based rare earth magnet, which is excellent in magnetic performance, ensures uniform quality, and is stably produced, by solving the problem that the distribution of the diffused heavy rare earth in the magnet is not uniform immediately after diffusion treatment because when a rare earth magnet sintered block semi-product is used, the heavy rare earth applied to the magnet surface is gradually diffused along the magnet grain boundaries and penetrated into the magnet, and the problem that cracks occur in a portion on which internal stress is extremely concentrated, and a heavy rare earth grain-boundary-diffused RE-Fe—B-based rare earth magnet produced thereby.

However, the technical object to be achieved by the present invention is not limited to the aforementioned object, but other objects that are not mentioned will be apparently understood by a person of ordinary skill in the art from the following description.

To achieve the above objects, the present invention provides a method for producing a heavy rare earth grain-boundary-diffused RE-Fe—B-based rare earth magnet, the method including: step S1 of processing a rare earth magnet sintered body having a composition of RE-Fe-TM-B (where RE=rare earth element, Fe=iron, TM=3d transition metal, and B=boron) according to the specification of the magnet product, and cleaning the processed sintered body by degreasing, pickling and solvent cleaning; step S2 of applying, to the surface of the cleaned sintered body of step S1, an application material containing one or more of Dy-H and Tb-H, which are hydrogen compounds of a heavy rare earth; and step S3 of placing the applied sintered body of step S2 in a heating furnace, and diffusing the heavy rare earth into the grain boundaries of the sintered body at a temperature of 600 to 1000° C. in a vacuum or inert gas atmosphere, thereby obtaining a diffused material.

In the heavy rare earth grain-boundary-diffused RE-Fe—B-based rare earth magnet producing method, step S3 may further include, after the diffusion, first heat treatment at a temperature between 900° C. and 1,000° C., then second heat treatment at a temperature between 600° C. and lower than 800° C., and then third heat treatment at a temperature between 450° C. and lower than 600° C.

At this time, the second heat treatment may be performed by rapid cooling at a cooling rate of 90 to 100° C./min and then carrying out heat treatment to a second heat treatment temperature after the first heat treatment.

In addition, the heavy rare earth grain-boundary-diffused RE-Fe—B-based rare earth magnet producing method according to the present invention may further include step S4 of surface-treating the diffused material of step S3 with a metal, an epoxy or a resin.

Further, in the heavy rare earth grain-boundary-diffused RE-Fe—B-based rare earth magnet producing method, the rare earth magnet sintered body may have a composition comprising 27 to 36 wt % of RE, 64 to 73 wt % of Fe, 0 to 5 wt % of TM, and more than 0 wt % and not more than 2 wt % of B.

In addition, in the heavy rare earth grain-boundary-diffused RE-Fe—B-based rare earth magnet producing method, the cleaning in step S1 may include at least one of processing, degreasing, pickling, and solvent cleaning processes.

In addition, in the heavy rare earth grain-boundary-diffused RE-Fe—B-based rare earth magnet producing method, the application material used in step S2 may be either a first heavy rare earth compound obtained by mixing at least 10 wt % of a Dy-H compound with the balance of a Dy-F compound, or a second heavy rare earth compound obtained by mixing at least 10 wt % of a Tb-H compound with a balance of a Tb-F compound.

Besides, in the heavy rare earth grain-boundary-diffused RE-Fe—B-based rare earth magnet producing method, the application material used in step S2 may be a mixture obtained by mixing a first heavy rare earth compound which is a mixture of at least 10 wt % of the Dy-H compound and the balance of the Dy-F compound, and a second heavy rare earth compound which is a mixture of at least 10 wt % of the Tb-H compound and the balance of the Tb-F compound, at a weight ratio of 1:0.4 to 0.6.

In addition, in the heavy rare earth grain-boundary-diffused RE-Fe—B-based rare earth magnet producing method, the diffusion in step S3 may include heating at a heating rate of 0.1 to 20° C./min and performing a diffusion reaction for 0.5 to 50 hours.

Further, in the heavy rare earth grain-boundary-diffused RE-Fe—B-based rare earth magnet producing method, the heat treatment after the diffusion in step S3 may be performed at at least two temperatures.

In addition, in the heavy rare earth grain-boundary-diffused RE-Fe—B-based rare earth magnet producing method, steps S1 to S3 may be performed repeatedly 1 to 50 times.

Moreover, in the heavy rare earth grain-boundary-diffused RE-Fe—B-based rare earth magnet producing method, the sintered body used in step (S1) may be produced by using a magnetic powder having an average particle diameter of 20 to 35 μm and a dispersion coefficient to particle diameter of 25 to 40% as calculated according to the following equation 1:

Particle diameter dispersion coefficient (%) of magnetic powder=particle diameter standard deviation (μm)×100/average particle diameter (μm) of magnetic powder. [Equation 1]

The heavy rare earth grain-boundary-diffused RE-Fe—B-based rare earth magnet according to the present invention may be produced by the method for producing a heavy rare earth grain-boundary-diffused RE-Fe—B-based rare earth magnet according to the present invention.

Effects of the Invention

According to the method for producing a heavy rare earth grain-boundary-diffused RE-Fe—B-based rare earth magnet and the heavy rare earth grain-boundary-diffused RE-Fe—B-based rare earth magnet produced thereby of according to the present invention, a hydrogen compound of a heavy rare earth is mainly used as a diffusion material in the production of a heavy rare earth grain-boundary-diffused RE-Fe—B-based rare earth sintered magnet having a reduced content of a heavy rare earth, so that a product having uniform and stable quality can be produced, and the coercive force of the magnet can be increased while minimizing the amount of heavy rare earth used, by solving the problem that the heavy rare earth is not uniformly diffused into the magnet.

In addition, according to the method for producing a heavy rare earth grain-boundary-diffused RE-Fe—B-based rare earth magnet and the heavy rare earth grain-boundary-diffused RE-Fe—B-based rare earth magnet produced thereby of according to the present invention, the coercive force and thermal demagnetization characteristics can be improved, and uniform quality of the product can be ensured by developing a technology that controls the diffusion rate and eliminates the residual stress through heat-treatment temperature and time, a change in heating rate, and a post-heat treatment such as repeated heat-treatment in order to improve the coercive force and thermal demagnetization characteristics of the magnet after grain boundary diffusion by eliminating the residual stress.

Further, according to the method for producing a heavy rare earth grain-boundary-diffused RE-Fe—B-based rare earth magnet and the heavy rare earth grain-boundary-diffused RE-Fe—B-based rare earth magnet produced thereby of according to the present invention, the production cost of the magnet can be significantly reduced and the coercive force and thermal stability of the magnet can be improved by using an improved heavy rare earth grain boundary diffusion technology using a rare earth sintered magnet as a starting material in the production of the rare earth sintered magnet which is widely used in various industrial fields, including the automotive field, the home appliances field, the IT field, and the medical field.

Besides, according to the method for producing a heavy rare earth grain-boundary-diffused RE-Fe—B-based rare earth magnet and the heavy rare earth grain-boundary-diffused RE-Fe—B-based rare earth magnet produced thereby of according to the present invention, a rare earth sintered magnet can be stably produced which is excellent in magnetic performance and ensures uniform quality, by solving the problem that the distribution of the diffused heavy rare earth in the magnet is not uniform immediately after diffusion treatment because when a rare earth magnet sintered block semi-product is used, the heavy rare earth applied to the magnet surface is gradually diffused along the magnet grain boundaries and penetrated into the magnet, and the problem that cracks occur in a portion on which internal stress is extremely concentrated.

The effects that are achieved by the present invention are not limited to the aforementioned effects, but other effects that are not mentioned will be apparently understood by a person of ordinary skill in the art from the following description.

DESCRIPTION OF THE PREFERRED EMBODIMENTS

Hereinafter, preferred examples of the present invention will be described in detail. The present invention may, however, be embodied in many different forms and should not be construed as being limited to the examples set forth herein. Rather, these examples are provided so that this disclosure will be thorough and complete and will fully convey the concept of the invention to those skilled in the art. Through the specification, like elements are designated by like reference numerals. Through the specification, like elements are designated by like reference numerals.

A method for producing a heavy rare earth grain-boundary-diffused RE-Fe—B-based rare earth magnet according to the present invention may comprises: step S1 of processing a rare earth magnet sintered body having a composition of RE-Fe-TM-B (where RE=rare earth element, Fe=iron, TM=3d transition metal, and B=boron) according to the specification of the magnet product, and cleaning the processed sintered body by degreasing, pickling and solvent cleaning; step S2 of applying, to the surface of the cleaned sintered body of step S1, an application material containing one or more of Dy-H and Tb-H, which are hydrogen compounds of a heavy rare earth; and step S3 of placing the applied sintered body of step S2 in a heating furnace, and diffusing the heavy rare earth into the grain boundaries of the sintered body at a temperature of 600 to 1000° C. in a vacuum or inert gas atmosphere.

Here, the rare earth magnet sintered body may, more specifically, have a composition comprising 27 to 36 wt % of RE, 64 to 73 wt % of Fe, 0 to 5 wt % of TM, and more than 0 wt % and not more than 2 wt % of B, and the cleaning of step S1 may comprise at least one of processing, degreasing, pickling, and solvent cleaning processes.

The processing and cleaning processes of step S1 of the present invention will now be described in more detail.

Specifically, in the present invention, a sintered body, comprising 27 to 36 wt % of RE, 64 to 73 wt % of Fe, 0 to 5 wt % of TM, and more than 0 wt % and not more than 2 wt % of B, and produced through an alloy manufacturing process→a powder preparation process→a magnetic field molding process→a sintering process among rare earth magnet production processes, may be used as a starting material.

In this case, the sintered body may be in the form of a final product or a block having a predetermined size.

When the sintered body is in the form of the final product, the rare earth sintered magnet may be produced to have various shapes, including a block shape, a volute shape, a ring shape, and a disc shape, according to consumer's requirement, and may also be produced to various sizes according to the consumer's requirement. In particular, as a magnet for use in a motor, a product having a thickness of 5 mm or less in the magnetic field direction may be mainly used.

As the thickness of a grain boundary diffused magnet in the magnetic field direction increases, the ratio of the area of a region, into which the heavy rare earth is diffused, to the total area of the magnet, decreases, and thus the performance and quality of the magnet become unstable. For this reason, a sintered body having a size of 50 mm (width)×50 mm (length)×25 mm (height, magnetic field direction) may be processed into a block having a size of 12.5 mm×12.5 mm×5 mm by means of a straight cutter and a plane grinder, thereby obtaining a magnet that has a sufficiently thick thickness in the magnetic field direction so that it can be applied to most finished products.

Since the heavy rare earth element penetrates into the grain boundary-diffused magnet through diffusion from the surface of the magnet into the inside of the magnet, it is important to keep the surface clean by removing foreign material, such as an oil component deposited on the surface of the sintered body during processing, and rust generated in portions of the surface. In the present invention, the oil component on the magnet is removed by immersing the sintered body in an alkaline degreasing agent solution, and then rubbing the sintered body with ceramic balls having a size of n (pi) 5 to 10, and then the degreasing agent remaining on the sintered body may be completely removed by cleaning the sintered body several times with distilled water. In a subsequent process, rust generated during processing can be completely removed by immersing the degreased sintered body in a nitric acid solution (nitric acid content: 1 to 10%) and pickling it for 1 to 5 minutes. After the pickling, the sintered body may be transferred into alcohol and distilled water, and cleaned with an ultrasonic cleaner to removing the nitric acid remaining on the surface of the sintered body, and then sufficiently dried.

Meanwhile, even when a sintered body block having an appropriate size is treated with a specific application material according to the present invention as described below and specific heat-treatment conditions are applied to the sintered body, there may be a difference in stress between the surface and the inside and a difference in the concentration of the diffused heavy rare earth element between the surface and the inside, which make it difficult to achieve uniform diffusion to the inside. For this reason, the sintered body may preferably be one produced from magnetic powders ground to have an average particle diameter and diffusion coefficient according to one embodiment of the present invention.

Specifically, the magnetic powder is preferably a powder having an average particle diameter of 20 to 35 μm, and may be a sintered body powder having a dispersion coefficient to particle diameter of 25 to 40% as calculated according to the following equation 1. In this case, there is an advantage in that the excellent magnetic properties of the final rare earth magnet can be expressed uniformly throughout the rare earth magnet, and thus the object of the present invention can be more easily achieved. In addition, in the application process of step S2 as described below, the application material containing the heavy rare earth element may be applied through multiple (two or more) steps. In this case, the heavy rare earth element can be uniformly diffused to the inside even through a single application process without having to perform heat treatment, and the magnet advantageously exhibits excellent magnetic properties.

Particle diameter dispersion coefficient (%) of magnetic powder=particle diameter standard deviation (μm)×100/average particle diameter (μm) of magnetic powder [Equation 1]

If the average particle diameter of the magnetic powder is smaller than 20 μm, the production of a rare earth oxide may increase and the coercive force may decrease rather than increase, and thus the object of the present invention may not be achieved. On the other hand, if the average particle diameter is larger than 35 μm, the diffusion of the heavy rare earth element to the center of the sintered body powder may not be uniform and cracks may occur in the sintered body, making it difficult to achieve the desired effect.

Meanwhile, the dispersion coefficient in equation 1 refers to the particle size distribution of the magnetic powder; a dispersion coefficient of 0 means that the particles of the powder have the same particle diameter; and an increased dispersion coefficient indicates that the number of particles far from the average increases, and thus the particle size distribution of the powder widens. In a preferred embodiment of the present invention, the magnetic powder has the above-described average particle diameter and, at the same time, satisfies a dispersion coefficient of 25 to 40% as calculated according to equation 1. In this case, the magnetic powder can exhibit further improved magnetic properties such as coercive force, easily exhibit uniform physical properties throughout the produced magnet, and defects such as cracks may not occur in all the external surface and the inside of the produced sintered body. If the dispersion coefficient is lower than 25% or higher than 40%, the coercive force characteristic may be reduced, or the magnetic characteristics may not be expressed uniformly throughout the produced magnet, and cracks may occur due to internal stress.

Hereinafter, the process of applying the heavy rare earth, which is step S2 of the present invention, will be described in more detail.

The application process of step S2 may be performed by treating the sintered body or the sintered body powder with the application material containing at least one heavy rare earth compound selected from among Dy-H and Tb-H.

It is important to uniformly apply the application material containing at least one heavy rare earth compound, selected from among Dy-H and Tb-H, to the surface of the pickled and cleaned sintered body. The process of applying the application material is as follows.

First, the heavy rare earth compound and a solvent such as ethanol or methanol are uniformly kneaded using a liquid kneader, thus preparing a heavy rare earth compound slurry which is the application material. At this time, the ratio of the solvent to the heavy rare earth compound may be 10 to 90 wt %, but is not limited thereto. Next, the prepared slurry is placed in a beaker, and the sintered body or the sintered body powder is immersed therein while it is uniformly dispersed using an ultrasonic cleaner. Next, the resulting slurry is maintained for 1 to 5 minutes, so that the heavy rare earth may be uniformly applied to the surface of the sintered body or the sintered body powder.

In the present invention, the application material containing one or more of Dy-H and Tb-H, which are hydrogen compounds of a heavy rare earth, is used to allow the heavy rare earth to be uniformly diffused into the magnet.

The present invention is characterized in that the application material containing one or more of a Dy-H compound and a Tb-H compound, which are hydrogen compounds of a heavy rare earth is used so that the heavy rare earth can be uniformly diffused into the magnet.

In addition, the application material may preferably be either a first heavy rare earth compound obtained by mixing at least 10 wt % (more preferably 10 to 25 wt %) of a Dy-H compound with the balance of a Dy-F compound, or a second heavy rare earth compound obtained by mixing at least 10 wt % (more preferably 10 to 25 wt %) of a Tb-H compound with a balance of a Tb-F compound.

When Dy is Tb is diffused into the magnet through the first heavy rare earth compound or second heavy rare earth compound as described above, there are advantages in that even when the above-described sintered body is a grain boundary-diffused rare earth magnet block having a certain size, the heavy rare earth element is uniformly diffused to the inside of the magnet block, and even when the sintered body is used as a block having a certain size, the occurrence of defects such as cracks in the sintered body is more easily prevented. In addition, in this case, the desired effect of the present invention can be easily achieved through a single-step application process without having to use an at least two-step application process which sequentially comprises applying a hydrogen compound of Dy or Tb, performing heat treatment, applying a fluorine compound of Dy or Tb, and performing heat treatment. In addition, this technical characteristic provides an advantage in that, particularly when the above-described sintered body to be applied is used as a sintered body powder in the present invention, the desired effect of the present invention can further be increased.

If the content of the Dy-H compound or the Tb-H compound in the first heavy rare earth compound or the second heavy rare earth compound is less than 10 wt %, the effect of uniform diffusion into the magnet will hardly appear. For this reason, the content is preferably at least 10 wt %. On the other hand, if the content of the Dy-H compound or the Tb-H compound is more than 25 wt %, the coercive force may decrease rather than increase or cracks may occur in the sintered body, making it difficult to achieve the object of the present invention.

Meanwhile, according to another embodiment of the present invention, the application material used in step S2 may be a mixture obtained by mixing a first heavy rare earth compound which is a mixture of at least 10 wt % of the Dy-H compound and the balance of the Dy-F compound, and a second heavy rare earth compound which is a mixture of at least 10 wt % of the Tb-H compound and the balance of the Tb-F compound, at a weight ratio of 1:0.4 to 0.6. In this case, there are advantages in that even when the sintered body in step S2 is a sintered body block having a certain size, the diffusion of the heavy rare earth element to the applied surface and the inside is further improved, and even when heat treatment after single-step application is performed, the resulting magnet can exhibit uniform magnetic characteristics. If the ratio of the content of the second heavy rare earth compound to the first heavy rare earth compound is less than 0.4, the magnet may hardly exhibit desired magnetic characteristics such as an increased coercive force, if the ratio is more than 0.6, the diffusion between the inside and the surface may decrease rather than increase, and thus the coercive force may be significantly reduced or uniform magnetic characteristics may hardly appear.

Hereinafter, the heavy rare earth diffusion and post-heat treatment process which is step S3 of the present invention will be described in more detail.

Step S3 is a step of placing the applied sintered body of step S2 in a heating furnace and diffusing the heavy rare earth into the grain boundaries of the sintered body at a temperature of 600 to 1,000° C. in a vacuum or argon atmosphere. Step S3 may further comprise, after the diffusion, first heat treatment at a temperature between 900° C. and 1,000° C., followed by second heat treatment at a temperature between 600° C. and lower than 800° C., and then third heat treatment at a temperature between 450° C. and lower than 600° C. The diffusion in step S3 may comprise heating at a heating rate of 0.1 to 20° C./min and performing a diffusion reaction for 0.5 to 50 hours. As the second heat treatment between the first heat treatment and the third heat treatment is further performed, the diffusion of the desired heavy rare earth component can further be improved, and a magnet with excellent quality can be obtained without causing cracks in the inside and outside of the heat-treated magnet.

In the present invention, a sintered body to which a heavy rare earth compound has been applied was first placed in a heating furnace, and then heated to a temperature of 600 to 1000° C. in a vacuum or argon atmosphere. It was maintained at that temperature for 1 to 20 hours, so that the heavy rare earth compound was decomposed into a heavy rare earth which was then diffused and penetrated into the magnet. At this time, the amount of heavy rare earth element that penetrated into the magnet by diffusion was in the range of 0.2 to 0.6 wt %, and the amount of heavy rare earth that penetrated increased in proportion to the diffusion temperature and the maintenance time.

Meanwhile, it was shown that as the diffusion temperature in the diffusion process increased, the amount of heavy rare earth that penetrated into the magnet increased, but the coercive force decreased rather than increased, and when the magnet was maintained at the highest diffusion temperature (950° C.) for 4 hours, severe cracks occurred in the magnet. This was believed to be because the difference in penetration of the heavy rare earth between the surface and the inside of the magnet increased as the diffusion progressed rapidly, and hence residual stress occurred in the magnet.

According to one preferred embodiment of the present invention, first to third heat treatments may further be performed after step S3 in order to prevent residual stress from occurring in the magnet due to this rapid diffusion. The first heat treatment may be performed at a temperature of 900 to 1000° C. and a heating rate of 10 to 20° C./min for 1 to 10 hours, and the second heat treatment may be performed by rapid cooling at a cooling rate of 90 to 100° C./min and then carrying out heat treatment to a temperature between 600° C. and lower than 800° C. for 1 to 3 hours, thereby further adjusting the diffusion and eliminating residual stress. If the second heat treatment is not performed or if heat treatment is not performed under the above-described conditions after cooling at the second heat-treatment cooling rate according to the present invention even though the second heat treatment is performed, a problem may arise in that it is not easy to eliminate residual stress, and thus cracks occurs in the sintered body block or the mechanical strength of the magnet produced from the sintered body powder is reduced. Thereafter, the third heat treatment may be performed at a temperature between 450° C. and lower than 600° C. and a cooling rate of 20 to 30° C./min for 1 to 5 hours. This third heat treatment may be advantageous for further effective elimination of the residual stress. If the cooling rate is beyond the preferable range limit in the third heat treatment, cracks may occur in the sintered body.

Finally, the process of surface-treating the diffused material, which is step S4 of the present invention, will now be described in more detail.

The method of the present invention may further comprise step S4 of surface-treating the diffused material of step S3 with a metal, an epoxy or a resin. More specifically, after completion of the grain boundary diffusion and the post-heat treatment, the product may be subjected to fine surface finishing or pickling treatment, and may be subjected to surface treatment, such as Ni coating, Zn coating, electrodeposition coating or epoxy coating, thereby producing a final product.

EXAMPLES

Hereinafter, the present invention will be described in further detail with reference to examples. These examples are provided to facilitate the understanding of the present invention. It will be obvious to a person having ordinary skill in the art that these examples are for illustrative purposes only and are not to be construed to limit the scope of the present invention.

Example 1

To prepare a rare earth sintered magnet having a composition comprising 29 wt % RE, 69.5 wt % Fe, 0.5 wt % Co, and 1 wt % B, which is used as a starting material, these components were mixed and melted to obtain an alloy. The alloy was subjected to strip casting, and then magnetic powder having an average particle diameter of 10 μm was prepared therefrom by a conventional method. Then, the prepared powder was placed in a mold in order to form a sintered body block having a size of 12.5 mm×12.5 mm×5 mm (magnetic field direction), and then pressured with 200 MPa. The pressed powder was sintered at 1000° C. for 3 hours in a vacuum atmosphere, thereby producing a magnet.

To remove foreign matter (such as an oil component) deposited on the surface and rust generated in portions of the surface, the sintered body block was immersed in an alkaline degreasing agent solution, and then rubbed with ceramic balls having a size of n (pi) 8, thereby removing an oil component from the magnet surface. Next, the magnet was cleaned several times with distilled water to completely remove the degreasing agent remaining thereon. In a subsequent process, the degreased sintered body was immersed in a nitric acid solution (nitric acid content: 5%) and pickled for 2 minutes, thereby removing rust generated during processing. After the pickling, the magnet was transferred into alcohol and distilled water and treated with an ultrasonic cleaner to remove the nitric acid remaining on the magnet surface, followed by sufficient drying.

To uniformly apply a heavy rare earth to the surface of the pickled and cleaned magnet, a mixture of 12 wt % of a Dy-H compound ($DyH_2$) and 88 wt % of a Dy-F compound ($DyF_3$) was uniformly kneaded with ethanol at a ratio of 50%:50%, thereby preparing a first heavy rare earth compound slurry. The prepared slurry was placed in a beaker and dispersed uniformly using an ultrasonic cleaner, thereby preparing an application material. The sintered body block was immersed in the application material, and then maintained therein for 2 minutes such that the heavy rare earth was uniformly applied to the magnet surface.

Next, to diffuse the applied first heavy rare earth compound into the grain boundaries of the magnet, the applied magnet was placed in a heating furnace, heated at a heating rate of 1° C./min in an Ar atmosphere, and maintained at 900° C. for 5 hours such that the heavy rare earth compound was decomposed into a heavy rare earth which was then diffused and penetrated into the magnet. At this time, the amount of heavy rare earth that diffused and penetrated into the magnet was about 0.4 wt %. Next, the magnet was cooled naturally, heated again from 25° C. at a heating rate of 20° C./min, subjected to a first heat treatment for stress removal at 850° C. for 8 hours, and then cooled rapidly at a cooling rate of 95° C./min, subjected to a second heat treatment at 750° C. for a total of 2 hours (including the cooling time), and then cooled at a cooling rate of 25° C./min, and subjected to a third heat treatment at a temperature of 500° C. for a total of 3 hours (including the cooling time), thereby producing a magnet as shown in Table 1 below.

Examples 2 to 4

Magnets as shown in Table 1 below were produced in the same manner as described in Example 1, except that the second heat treatment was not performed or the cooling rate during the second heat treatment was changed.

Comparative Example 1

A magnet was produced in the same manner as described in Example 1, except that the first to third heat treatments were not performed.

Test Example 1

For Examples 1 to 3 and Comparative Example 1, the physical properties described below were evaluated, and the results of the evaluation are shown in Table 1 below.

1. Magnetic Properties

The residual magnetic flux density and coercive force properties of each specimen were evaluated at 25° C.

2. Whether Specimen was Damaged

First, the appearance of each specimen was observed with an optical microscope to evaluate whether a crack occurred in the specimen, and as a result, when the specimen had no crack therein, it was indicated by x. Next, each specimen was divided into six equal parts and the sections thereof were observed. A total of 10 internal sections were observed with an optical microscope, and the specimen having no crack therein was indicated by 0, and the specimen having a crack was indicated by 1 to 10 depending on the number of sections having a crack, among the 10 sections.

TABLE 1

| | Diffusion/Heat Treatment Conditions | | | | | | |
|---|---|---|---|---|---|---|---|
| | | Second heat treatment | | | | | |
| | Diffusion temp. (° C.) | Cooling rate (° C./min) | Heat treatment temp. (° C.) | Total time (hr) | Residual magnetic flux density Br (kG) | Coercive force Hcj (kOe) | Specimen damaged |
| Comp. Ex. 1 | 900 | — | — | — | 13.6 | 26.3 | x |
| Example 1 | 900 | 95 | 750 | 2 | 13.5 | 33.8 | 2 |
| Example 2 | 900 | 85 | 750 | 2 | 13.5 | 29.9 | 2 |
| Example 3 | 900 | 105 | 750 | 2 | 13.5 | 34.0 | 6 |
| Example 4 | 900 | Not performed | | | 13.5 | 28.2 | 7 |

As can be seen in Table 1 above, it can be confirmed that the coercive force of the specimen of Comparative Example 1 was significantly poorer than those of the Examples, and a crack already occurred on the appearance surface of the specimen. In addition, it can be confirmed that the specimen of Example 4, which was not subjected to the second heat treatment, was interior to those of Examples 1 to 3 in terms of both the coercive force and whether the specimen was damaged.

In addition, as can be seen in Table 1 above, the specimen of Example 1, which was cooled for second heat treatment at the preferred cooling rate range of the present invention, exhibited very excellent effects in terms of the coercive force and whether the specimen was damaged.

Examples 5 to 7

Magnets as shown in Table 2 below were produced in the same manner as described in Example 1, except that the contents of the Dy-H compound and the Dy-F compound were changed as shown in Table 2 below.

Comparative Example 2

A magnet as shown in Table 2 below was produced in the same manner as described in Example 1, except that the Dy-H compound was not used and only the Dy-F compound was used.

Test Example 2

For Examples 5 to 7 and Comparative Example 2, the physical properties of specimens were evaluated in the same manner as described in Test Example 1, and the results of the evaluation are shown in Table 2 below.

TABLE 2

| | DyH:DyF (wt %) | Residual magnetic flux density Br(kG) | Coercive force Hcj(kOe) | Specimen damaged |
|---|---|---|---|---|
| Comp. Ex. 2 | 0:100 | 13.6 | 22.0 | 2 |
| Example 5 | 7:93 | 13.5 | 25.5 | 2 |
| Example 1 | 12:90 | 13.5 | 33.8 | 2 |
| Example 6 | 24:76 | 13.5 | 34.0 | 2 |
| Example 7 | 28:72 | 13.5 | 34.1 | 5 |

As can be seen in Table 2 above, it can be confirmed that the coercive force of the specimen of Comparative Example 2 was significantly poorer than those of the Examples.

In addition, it can be confirmed that, among the Examples, Examples 1 and 6, in which then first heavy rare earth compound was added in an amount in the preferred range of the present invention, achieved the two effects (i.e., increasing the coercive force and preventing the specimen from being damaged), unlike the remaining Examples.

Examples 8 to 13

Magnets as shown in Table 3 below were produced in the same manner as described in Example 1, except that sintered body blocks to be treated with the application material containing the first heavy rare earth compound were produced to have the same size in the same manner using magnetic powders having the average particle diameter and dispersion coefficient as shown in Table 3 below.

Test Example 3

The specimens prepared in Examples 8 to 13 above were evaluated in the same manner as described in Test Example 1, and the results of the evaluation are shown in Table 3 below.

TABLE 3

| | particle size distribution of the magnetic powder | | Residual | | |
|---|---|---|---|---|---|
| | Average particle diameter (μm) | Dispersion coefficient (%) | magnetic flux density Br(kG) | Coercive force Hcj(kOe) | Specimen damaged |
| Example 1 | 10 | — | 13.5 | 33.8 | 2 |
| Example 8 | 23 | 28 | 13.5 | 36.9 | 0 |
| Example 9 | 23 | 20 | 13.6 | 34.1 | 1 |
| Example 10 | 23 | 38 | 13.6 | 37.3 | 0 |
| Example 11 | 23 | 45 | 13.5 | 33.3 | 3 |
| Example 12 | 15 | 28 | 13.4 | 34.5 | 0 |
| Example 13 | 33 | 28 | 13.6 | 37.9 | 0 |
| Example 14 | 40 | 28 | 13.5 | 37.7 | 3 |

As can be seen in Table 3 above, it can be confirmed that Examples 8, 10 and 13, in which the particle size distribution of the magnetic powder was within the preferred range of the present invention, showed excellent coercive force and less damage to the specimen, compared to other Examples.

Example 14

A magnet as shown in Table 14 below was produced in the same manner as described in Example 1, except that an application material, prepared by uniformly kneading a mixture of 12 wt % of a Tb-H compound ($TbH_2$) and 88 wt % of a Tb-F compound ($TbF_3$) with ethanol at a ratio of 50%:50%, thereby preparing a second heavy rare earth slurry, and then placing the prepared slurry in a beaker and uniformly dispersing the slurry using an ultrasonic cleaner, was used instead of the application material which is the first heavy rare earth compound slurry.

Examples 15 to 17

Magnets as shown in Table 4 below were produced in the same manner as described in Example 14, except that the second heat treatment was not performed or the cooling rate during the second heat treatment was changed.

Comparative Example 3

A magnet was produced in the same manner as described in Example 14, except that the first to third heat-treatment processes were not performed.

Test Example 4

For Examples 14 to 17 and Comparative Example 3, the physical properties of specimens were evaluated in the same manner as described in Test Example 1, and the results of the evaluation are shown in Table 4 below.

TABLE 4

| | Diffusion/Heat Treatment Conditions | | | | | | |
|---|---|---|---|---|---|---|---|
| | | Second heat treatment | | | | | |
| | Diffusion temp. (° C.) | Cooling rate (° C./min) | Heat treatment temp. (° C.) | Total time (hr) | Residual magnetic flux density Br (kG) | Coercive force Hcj (kOe) | Specimen damaged |
| Comp. Ex. 3 | 900 | — | — | — | 13.6 | 22.2 | x |
| Example 14 | 900 | 95 | 750 | 2 | 13.5 | 33.6 | 2 |
| Example 15 | 900 | 85 | 750 | 2 | 13.5 | 30.5 | 3 |
| Example 16 | 900 | 105 | 750 | 2 | 13.5 | 34.7 | 6 |
| Example 17 | 900 | Not performed | | | 13.5 | 25.5 | 7 |

As can be seen in Table 4 above, Example 14, in which the second heat treatment was performed after cooling at the preferred cooling rate according to the present invention, showed excellent coercive force and less damage to the specimen, like the results shown in Table 1 above.

Examples 18 to 20

Magnets as shown in Table 5 below were produced in the same manner as described in Example 14, except that the contents of the Tb-H compound and the Tb-F compound were changed as shown in Table 5 below.

Comparative Example 4

A magnet as shown in Table 5 below was produced in the same manner as described in Example 1, except that the Dy-H compound was not used and only the Dy-F compound was used.

Test Example 5

For Examples 18 to 20 and Comparative Example 4, the physical properties of specimens were evaluated in the same manner as described in Test Example 1, and the results of the evaluation are shown in Table 5 below.

TABLE 5

| | Tb-H:Tb-F (wt %) | Residual magnetic flux density Br(kG) | Coercive force Hcj(kOe) | Specimen damaged |
|---|---|---|---|---|
| Comp. Ex. 4 | 0:100 | 13.5 | 25.5 | 2 |
| Example 18 | 7:93 | 13.5 | 27.6 | 2 |
| Example 14 | 12:90 | 13.5 | 33.6 | 2 |
| Example 19 | 24:76 | 13.5 | 34.3 | 3 |
| Example 20 | 28:72 | 13.5 | 34.9 | 6 |

As can be seen in Table 5 above, the coercive force of Comparative Example 4 was significantly poorer than those of the Examples.

In addition, it can be conformed that among the Examples, Examples 14 and 19, in which the second heavy rare earth compound was added in an amount in the preferred range of the present invention, achieved the two effects (i.e., of increasing the coercive force and preventing the specimen from being damaged), unlike the remaining Examples.

While the present invention has been described in connection with the exemplary embodiments illustrated in the drawings, they are merely illustrative and the invention is not limited to these embodiments. It will be appreciated by a person having an ordinary skill in the art that various equivalent modifications and variations of the embodiments can be made without departing from the spirit and scope of the present invention. Therefore, the true technical scope of the present invention should be defined by the technical spirit of the appended claims.

What is claimed is:

1. A method for producing a heavy rare earth grain-boundary-diffused RE-Fe—B-based rare earth magnet, the method comprising:

cleaning a rare earth magnet sintered body having a composition of RE-Fe-TM-B, where RE=rare earth element, Fe=iron, TM=3d transition metal, and B=boron, by degreasing, pickling and solvent cleaning;

applying, to the surface of the cleaned sintered body from the cleaning, an application material, wherein the application material is a mixture of 10-25 wt % of a Dy-H compound and a balance of a Dy-F compound, where the Dy-H compound is a hydrogen compound of a heavy rare earth element Dy and the Dy-F compound is a fluorine compound of a heavy rare earth element Dy; and placing the applied sintered body from the applying in a heating furnace, and diffusing the heavy rare earth element into the grain boundaries of the sintered body at a temperature of 600 to 1000° C. in a vacuum or inert gas atmosphere, thereby obtaining a diffused material, wherein the rare earth magnet sintered body has a composition comprising 27 to less than 36 wt % of RE, 64 to less than 73 wt % of Fe, more than 0 wt % and not more than 5 wt % of TM, and more than 0 wt % and not more than 2 wt % of B, and wherein the sintered body from the cleaning is produced by using a magnetic powder having an average particle diameter of 20 to 35 μm and a dispersion coefficient to particle diameter of 25 to 40% as calculated according to the following Equation 1, a dispersion coefficient (%) to particle diameter of magnetic powder=particle diameter standard deviation(μm)×100/average particle diameter (μm) of magnetic powder, [Equation 1]

wherein the placing of the applied sintered body further comprises, after the diffusion, first heat treatment at a temperature between 900° C. and 1,000° C., followed by second heat treatment at a temperature between 600° C. and lower than 800° C., and then third heat treatment at a temperature between 450° C. and lower than 600° C., and wherein the second heat treatment is performed by rapid cooling at a cooling rate of 90 to 100° C./min and then carrying out heat treatment to a second heat treatment temperature after the first heat treatment.

2. The method according to claim 1, further comprising surface-treating the diffused material from the placing of the applied sintered body with a metal, an epoxy or a resin.

3. The method according to claim 1, wherein the diffusion in from the placing of the applied sintered body in the heating furnace comprises heating at a heating rate of 0.1 to 20° C./min and performing a diffusion reaction for 0.5 to 50 hours.

4. The method according to claim 1, wherein the application material used in the applying of the application material is a mixture obtained by mixing the 10-25 wt % Dy-H compound and a balance of Dy-F compound mixture with a second heavy rare earth compound mixture of 10-25 wt % of a Tb-H compound and a balance of a Tb-F compound, at a weight ratio of 1:0.4 to 0.6, where the Tb-H compound is a hydrogen compound of a heavy rare earth element Tb and the Tb-F compound is a fluorine compound of a heavy rare earth element Tb.

5. A method for producing a heavy rare earth grain-boundary-diffused RE-Fe—B-based rare earth magnet, the method comprising:

cleaning a rare earth magnet sintered body having a composition of RE-Fe-TM-B, where RE=rare earth element, Fe=iron, TM=3d transition metal, and B=boron, by degreasing, pickling and solvent cleaning;

applying, to the surface of the cleaned sintered body from the cleaning, an application material, wherein the application material is a mixture of 10-25 wt % of a Tb-H compound and a balance of a Tb-F compound, where the Tb-H compound is a hydrogen compound of a heavy rare earth element Tb and the Tb-F compound is a fluorine compound of a heavy rare earth element Tb; and placing the applied sintered body from the applying in a heating furnace, and diffusing the heavy rare earth element into the grain boundaries of the sintered body at a temperature of 600 to 1000° C. in a vacuum or inert gas atmosphere, thereby obtaining a diffused material, wherein the rare earth magnet sintered body has a composition comprising 27 to less than 36 wt % of RE, 64 to less than 73 wt % of Fe, more than 0 wt % and not more than 5 wt % of TM, and more than 0 wt % and not more than 2 wt % of B, and wherein the sintered body from the cleaning is produced by using a magnetic powder having an average particle diameter of 20 to 35 μm and a dispersion coefficient to particle diameter of 25 to 40% as calculated according to the following Equation 1, a dispersion coefficient (%) to particle diameter of magnetic powder=particle diameter standard deviation(μm)×100/average particle diameter (μm) of magnetic powder, [Equation 1]

wherein the placing of the applied sintered body further comprises, after the diffusion, first heat treatment at a temperature between 900° C. and 1,000° C., followed by second heat treatment at a temperature between 600° C. and lower than 800° C., and then third heat treatment at a temperature between 450° C. and lower than 600° C., and wherein the second heat treatment is performed by rapid cooling at a cooling rate of 90 to 100° C./min and then carrying out heat treatment to a second heat treatment temperature after the first heat treatment.

* * * * *